US005977873A

United States Patent [19]

Woods

[11] Patent Number: 5,977,873

[45] Date of Patent: Nov. 2, 1999

[54] ALARM SWITCH

[76] Inventor: Randall Woods, 230 Longbranch E., Prescott, Ariz. 86303

[21] Appl. No.: 09/034,670

[22] Filed: Mar. 4, 1998

[51] Int. Cl.[6] ..... G08B 13/08

[52] U.S. Cl. ..... 340/547; 340/545.1; 335/205; 335/207

[58] Field of Search ..... 340/542, 545.1, 340/545.2, 545.3, 545.4, 545.5, 547, 551; 335/205, 207

[56] References Cited

U.S. PATENT DOCUMENTS

| | | | |
|---|---|---|---|
| 1,051,962 | 2/1913 | Lundquist | 116/86 |
| 1,192,893 | 8/1916 | Harvey | 116/88 |
| 1,868,923 | 7/1932 | Semon | 116/88 |
| 3,516,036 | 6/1970 | Lea | 335/207 |
| 3,535,664 | 10/1970 | Staar | 335/153 |
| 3,630,168 | 12/1971 | Fladlay | 116/74 |
| 3,650,347 | 3/1972 | Campos | 180/282 |
| 3,763,484 | 10/1973 | Byers | 340/669 |
| 3,816,680 | 6/1974 | Suzuki et al. | 200/65.51 |
| 3,842,377 | 10/1974 | Barndt | 335/207 |
| 4,042,796 | 8/1977 | Zink | 200/61.45 R |
| 4,057,773 | 11/1977 | Cohen | 335/205 |
| 4,062,314 | 12/1977 | Allen et al. | 116/85 |
| 4,168,410 | 9/1979 | Norris | 200/61.45 M |
| 4,275,391 | 6/1981 | Okamura | 340/571 |
| 4,293,860 | 10/1981 | Iwata | 343/715 |
| 4,326,196 | 4/1982 | Plevy | 340/545.5 |
| 4,336,518 | 6/1982 | Holce et al. | 335/205 |
| 4,450,326 | 5/1984 | Ledger | 200/61.45 M |
| 4,456,897 | 6/1984 | Holce et al. | 335/205 |
| 4,553,134 | 11/1985 | Holt | 340/546 |
| 4,567,846 | 2/1986 | Kurtz | 116/86 |
| 4,628,160 | 12/1986 | Canevari | 200/61.45 R |
| 4,656,458 | 4/1987 | Iwata | 340/669 |
| 4,733,324 | 3/1988 | George | 361/118 |
| 4,788,517 | 11/1988 | Meister | 335/205 |
| 4,982,058 | 1/1991 | Schroeder et al. | 200/61.62 |
| 5,192,839 | 3/1993 | Imade et al. | 200/61.45 R |
| 5,248,861 | 9/1993 | Kato et al. | 200/61.45 M |
| 5,248,959 | 9/1993 | Chern | 340/601 |
| 5,332,992 | 7/1994 | Woods | 340/547 |
| 5,530,428 | 6/1996 | Woods | 340/547 |
| 5,543,767 | 8/1996 | Elenbaas | 335/205 |
| 5,673,021 | 9/1997 | Woods | 340/547 |
| 5,867,082 | 2/1999 | Van Zeeland | 335/205 |
| 5,880,659 | 3/1999 | Woods | 335/207 |

*Primary Examiner*—Jeffery A. Hofsass
*Assistant Examiner*—Van T. Trieu
*Attorney, Agent, or Firm*—Hovey, Williams, Timmons & Collins

[57] ABSTRACT

A magnetic switch apparatus (10) detects relative movement between first (12) and second (14) members and defeats attempted external magnetic manipulation of the apparatus. A rod-shaped, first switch element (20) is positioned transverse to and centrally aligned with a convex, second switch element (22) and spaced therefrom. A ring-shaped first magnet (26) is positioned about the first switch element (20) and spaced from the second element (22) in order to pull a ferromagnetic body (24) into a switch-open position out of contact with the second switch element (22) with these components mounted to the first member (12). A second magnet (18) mounted to the second member (14) is positioned and magnetically sufficient to pull the body (24) into a switch-closed position in contact with both of the switch elements (20, 22) when the members (12, 14) are in an adjacent position.

15 Claims, 1 Drawing Sheet

ALARM SWITCH

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention is concerned with the field of magnetic switches. In particular, the invention is concerned with a magnetic switch apparatus that detects relative movement between first and second members and defeats attempted external magnetic manipulation of the apparatus.

2. Description of the Prior Art

Prior art security alarm systems use magnetic switches attached to doors and windows and integrated with the system for detecting unauthorized opening indicating an intruder. One common type of magnetic switch is a so-called reed switch. This type of switch is subject to manipulation by an external magnet. That is, an intruder can use a magnet to hold the read switch closed (or open depending upon the control scheme) and thereby open a door or window without triggering the alarm system.

SUMMARY OF THE INVENTION

The present invention solves the prior art problem discussed above and provides a distinct advance in the state of the art. More particularly, the alarm switch hereof is configured to defeat attempts at external magnetic manipulation.

The preferred embodiment includes a rod-shaped, first switch element positioned transverse to and centrally aligned with a convex, second switch element and spaced therefrom. A ring-shaped first magnet is positioned about the first switch element and spaced from the second element in order to pull a ferromagnetic body into a switch-open position out of contact with the second switch element. These components are mounted to the first member such as a door frame. A second magnet mounted to the second member, such as the door, is positioned and magnetically sufficient to pull the body into a switch-closed position in contact with both of the switch elements when the members are in an adjacent position, that is, when the door is closed.

When the second member is moved to a separating position relative to the first member such as when the door is open, the second magnet is no longer effective to hold the body against both switch elements and the first magnet pulls the body out of contact with the second switch element to trigger the alarm system. Any use of an external magnet pulls the ferromagnetic body away from the centrally located first element thereby simulating an open door condition and triggering the alarm system. Other preferred aspects of the present invention are disclosed herein.

DETAILED DESCRIPTION OF THE PREFERRED EMBODIMENT

Figure 1:
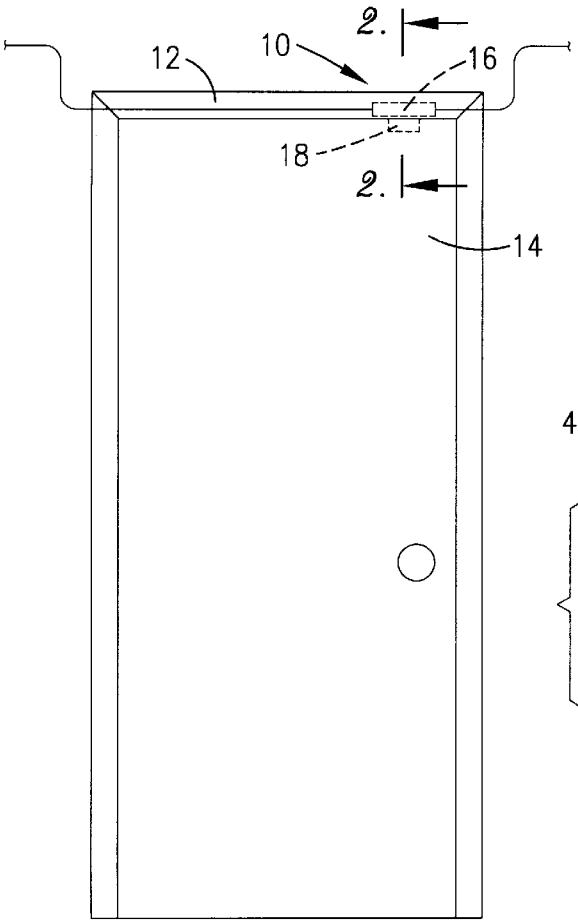
FIG. 1 illustrates preferred magnetic switch apparatus (shown in dashed lines) in accordance with the present invention and shown in use with a door frame and door.
Figure 2:
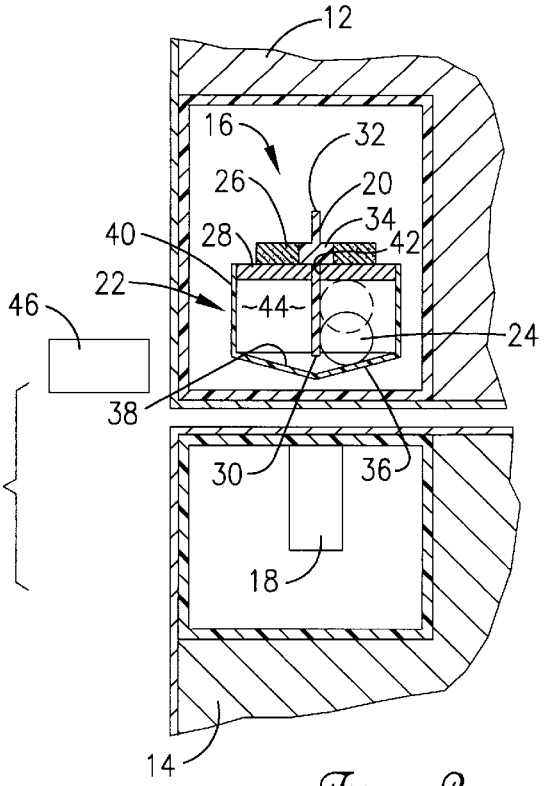
FIG. 2 is a sectional view taken along lines 2—2 of FIG. 1 and also showing an intruder magnet.

FIG. 1 illustrates preferred magnetic switch apparatus 10 (dashed lines) in accordance with the present invention shown in use with a door frame 12 and door 14. FIG. 2 more clearly illustrates the details of apparatus 10 which broadly includes switch assembly 16 and operating magnet 18.

Switch assembly 16 includes first switch element 20, second switch element 22, a ferromagnetic body in the form of ball 24, retraction magnet 26 and electrically insulating upper wall 28. First switch element 20 has a generally rod-shaped configuration and presents lower end 30 and upper end 32 with flange 34 therebetween nearest upper end 32. Element 20 is preferably composed of metal to be electrically conductive.

Electrically conductive, second switch element 22 is integrally formed of sheet metal such as by stamping and includes disk-shaped bottom wall 36 presenting contact surface 38 and further includes side wall 40 circumscribing bottom wall 36. As illustrated in FIG. 2, bottom wall 36 is shaped so that contact surface 38 presents a convex configuration and in particular, a reversed, conically shaped configuration.

Upper wall 28 is preferably composed of glass (or other insulating material) and electrically insulates switch elements 20, 22 from one another. Upper wall 28 is spaced from contact surface 38 and is circumscribed by side wall 40. The outboard face of upper wall 28 is flush with the upper edge of side wall 40.

Upper wall 28 also includes central opening 42 defined therein for receiving the lower portion of first switch element 20 with flange 34 thereof engaging the outboard face of upper wall 28. This positions first switch element 20 in alignment with the axis of contact surface 38 and spaces lower end 30 from contact surface 38.

Upper wall 28, bottom wall 36 and side wall 40 define switch chamber 44 with ferromagnetic ball 24 contained therein. As will be appreciated, ball 24 is electrically conductive and can be configured in other shapes such as a cube or cylinder, although the spherical shape is preferred.

Ball 24 is shiftable within chamber 44 between a switch-open position and a switch-closed position. In the switch-open position, ball 24 is not in contact with both switch elements 20, 22. Such a position is illustrated by the dashed lines in FIG. 2 wherein ball 24 is in contact with only one of the switch elements, namely first switch element 20. The switch-open position can occur also if ball 24 shifts along contact surface 38 toward side wall 40 and out of contact with switch element 20. The switch-closed position is illustrated by the solid lines in FIG. 2 in which ball 24 is in contact with both switch elements 20, 22.

Retraction magnet 26 presents a ring-shaped configuration in the nature of a torus and is positioned adjacent the outboard face of upper wall 28 surrounding flange 34 and thereby in surrounding relationship with first switch element 20. This arrangement positions magnet 18 spaced from contact surface 38. The magnetic field strength of magnet 26 is sufficient to shift ball 24 to the switch-open position illustrated in FIG. 2 in the absence of other magnetic effects such as that of operating magnet 18 discussed further herein. It will be appreciated that magnet 26 can take other shapes such as a rod, cylinder or ball or any other shape that would fit above the switch unit and serve to shift ball 24.

In use, switch assembly 16 is installed in door frame 12 and operating magnet 18 is installed in door 14 as illustrated in FIGS. 1 and 2. With door 14 closed, frame 12 and door 14 are in an adjacent position with operating magnet 18 aligned with switch assembly 16. Magnet 18 presents sufficient field strength to shift ball 24 to the switch-closed position.

When door 14 is open, door frame 12 and door 14 are in a separated position and operating magnet 18 is no longer aligned with switch assembly 16. This allows retraction magnet 26 to shift ball 24 to the switch-open position.

FIG. 2 also illustrates intruder magnet 46 positioned adjacent the side of switch assembly 16. Placement of intruder magnet 46 as shown causes ball 24 to shift along contact surface 38 toward side wall 40 in the direction of intruder magnet 46. This is also a switch-open position and simulates the opening of door 14. Thus, the use of an intruder magnet results in an alarm condition because of the structure of switch assembly 16. In this way, apparatus 10 defeats the use of an intruder magnet which has been a problem with the prior art.

Figure 3:
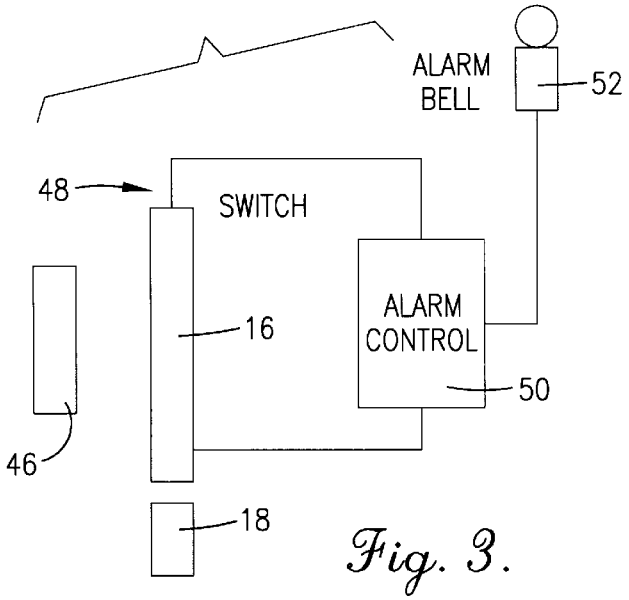
FIG. 3 is a schematic illustration of the preferred alarm system using the apparatus of FIG. 1 in accordance with the present invention.
Figure 4:
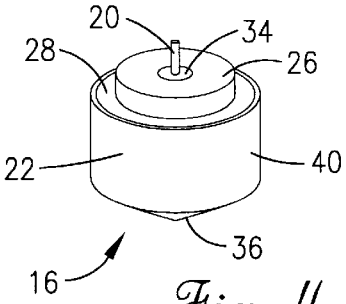
FIG. 4 is a top front pictorial view of the preferred magnet switch assembly of FIG. 1.

FIG. 3 is a schematic illustration of the preferred alarm 48 system using preferred apparatus 10. System 48 includes conventional alarm control 50 and an alarm output such as alarm bell 52. Apparatus 10 is used in system 48 as a contact switch triggering alarm control 50 whenever apparatus 10 is in the switch-open position, unless system 48 has been disarmed.

Having thus disclosed the preferred embodiment of the present invention, the following is claimed as new and desired to be secured by Letters Patent:

1. A magnetic switch apparatus for detecting relative movement between first and second members, said apparatus comprising:

a switch assembly for mounting to the first member, said assembly including a first switch element presenting a generally rod-shaped configuration, a second switch element presenting a generally disc-shaped configuration and having a contact surface, structure positioning said first switch element generally transverse to said contact surface and spaced therefrom, a ferromagnetic body shiftable between a switch-open position in which said body is out of contact with both of said first and second elements and a switch-closed position in which said body is in electrical contact with both said element and said contact surface; and a first magnet spaced from said contact surface and positioned for magnetically shifting said body to said switch-open position; and a second magnet for mounting to the second member and positioned on an opposed side of said contact surface relative to said first switch element, said second magnet being magnetically sufficient for shifting said body to said switch-closed position when the members are in an adjacent position, and for allowing said first magnet to shift said body to said switch-open position when the members are separated.

2. The apparatus as set forth in claim 1, said contact surface presenting a generally convex configuration relative to said first switch element.

3. The apparatus as set forth in claim 2, said contact surface presenting a generally reversed conically shaped configuration.

4. The apparatus as set forth in claim 1, said contact surface presenting a central axis with said first switch contact generally aligned with said axis.

5. The apparatus as set forth in claim 1, said second switch element including a side wall circumscribing said contact surface as a bottom wall.

6. The apparatus as set forth in claim 5, said second switch element being integrally formed of metal.

7. The apparatus as set forth in claim 6, said switch assembly including an electrically insulating top wall spaced from said contact surface and circumscribed by said bottom wall to define a switching chamber containing said body.

8. The apparatus as set forth in claim 7, said first switch element including an extended portion extending outwardly through said top wall.

9. The apparatus as set forth in claim 8, said first magnet being ring-shaped and positioned adjacent said top wall and surrounding said extended portion.

10. The apparatus as set forth in claim 9, said body presenting a generally spherical configuration.

11. The apparatus as set forth in claim 1, said body presenting a generally spherical configuration.

12. The apparatus as set forth in claim 1, said switch-open position being an electrically open switch position, said switch-closed position being an electrically closed switch position.

13. The apparatus as set forth in claim 1, said switch elements being located so that said body shifts to a switch-open position when the members are in the adjacent position and when an external magnet is applied in the vicinity of the first member in an attempt to manipulate magnetically said apparatus.

14. A magnetic switch apparatus for detecting relative movement between first and second members, said apparatus comprising:

a switch assembly for mounting to the first member, said assembly including a first switch element presenting a generally rod-shaped configuration, a second switch element presenting a generally disc-shaped configuration and having a convex contact surface presenting a central axis an electrically insulating top wall spaced from said contact surface, centrally receiving an extension portion of said first switch element therethrough, and positioning said first switch element generally aligned with said axis of said contact surface and spaced therefrom, a ferromagnetic ball shiftable between a switch-open position in which said body is out of contact with both of said elements and a switch-closed position in which said body is in electrical contact with both said element and said contact surface, said switch-open position being an electrically open switch position, said switch-closed position being an electrically closed switch position, and a ring-shaped, first magnet surrounding said extension portion and positioned for magnetically shifting said body to said switch-open position; and a second magnet for mounting to the second member and positioned on an opposed side of said contact surface relative to said first switch element, said second magnet being sufficient magnetically for shifting said body to said switch-closed position when the members are in an adjacent position, and for allowing said first magnet to shift said body to said switch-open position when the members are separated.

15. An alarm system for activating an alarm upon shifting of first and second members from an adjacent position to a separated position and upon attempted manipulation by an external magnet of the alarm system when the members are in the adjacent position, said system comprising:

a switch apparatus; and an alarm control coupled with said switch apparatus and responsive to a change in state thereof for activating an alarm, said switch apparatus including a switch assembly for mounting to the first member, said assembly including a first switch element presenting a generally rod-shaped configuration, a second switch element presenting a generally disc-shaped configuration and having a contact surface, structure positioning said first switch element generally transverse to said contact surface and spaced therefrom, a ferromagnetic body shiftable between a switch-open position in which said body is out of contact with both of said elements and a switch-closed position in which said body is in electrical contact with both said element and said contact surface, a first magnet spaced from said contact surface and positioned for magnetically shifting said body to said switch-open position, a second magnet for mounting to the second member and positioned on an opposed side of said contact surface relative to said first switch element, said second magnet being sufficient magnetically for shifting said body to said switch-closed position when the members are in an adjacent position, and for allowing said first magnet to shift said body to said switch-open position when the members are separated, said switch elements being located so that said body shifts to a switch-open position when the members are in the adjacent position and when an external magnet is applied in the vicinity of the first member in an attempt to manipulate magnetically said apparatus.

* * * * *